US005314391A

United States Patent [19]

Potash et al.

[11] Patent Number: 5,314,391

[45] Date of Patent: May 24, 1994

[54] ADAPTIVE TREADMILL

[75] Inventors: Robert L. Potash, Dedham; Carl J. Jentges, Brighton, both of Mass.; Stephen K. Burns, Durham, N.H.; Richard J. Potash, Dedham, Mass.

[73] Assignee: Computer Sports Medicine, Inc., Waltham, Mass.

[21] Appl. No.: 897,250

[22] Filed: Jun. 11, 1992

[51] Int. Cl.[5] ..... A63B 24/00

[52] U.S. Cl. ..... 482/7; 482/4; 482/54; 482/900; 482/901; 73/379.06; 340/573

[58] Field of Search ..... 482/1, 4–8, 482/52, 54, 57, 72, 900–903; 128/25 R, 26 B, 705; 273/434, 439, DIG. 28; 119/29; 73/379.01, 379.06; 340/552–554, 573; 367/39, 93, 94; 364/410

[56] References Cited

U.S. PATENT DOCUMENTS

| | | | |
|---|---|---|---|
| 1,919,627 | 7/1933 | Fitz Gerald | 482/54 X |
| 3,383,678 | 5/1968 | Palmer | 340/554 X |
| 3,602,502 | 8/1971 | Hampl | 482/7 |
| 4,708,337 | 11/1987 | Shyn | 482/54 |
| 4,919,416 | 4/1990 | DeCloux | 482/54 X |
| 4,958,835 | 9/1990 | Tashiro et al. | 273/DIG. 28 X |
| 5,089,960 | 2/1992 | Sweeney, Jr. | 434/61 X |

FOREIGN PATENT DOCUMENTS

| | | | |
|---|---|---|---|
| 0441104 | 8/1991 | European Pat. Off. | 482/54 |
| 1463323 | 3/1989 | U.S.S.R. | 482/54 |

*Primary Examiner*—Richard J. Apley
*Assistant Examiner*—Joe H. Cheng
*Attorney, Agent, or Firm*—Arthur L. Lessler

[57] ABSTRACT

A motor-driven treadmill includes a stationary ultrasonic range finder which continuously measures the distance to the torso of a person walking or running on the moving tread of the treadmill. When the person approaches too closely to the front of the treadmill, the treadmill speed and/or the treadmill slope are increased; and when the person retreats too far away from the front of the treadmill, the treadmill speed and/or the treadmill slope are decreased. The response of the treadmill speed and/or slope control system may be improved by making the controller responsive to the rate of change of the distance between the person using the treadmill and the front of the treadmill, so as to provide anticipation of the distances which will be traversed by the user of the treadmill.

29 Claims, 6 Drawing Sheets

ADAPTIVE TREADMILL

BACKGROUND OF THE INVENTION

This invention relates to a motor-driven treadmill for providing a variable level of exercise, and more particularly to a treadmill of that type wherein the level of exercise is responsive to the performance of a person using the treadmill.

Treadmills which are capable of varying the level of exercise, by varying the speed and/or slope of the treadmill by means of controls operated by the user, are known in the art.

Also known in the art are treadmills which are capable of automatically varying the speed and/or slope of the treadmill according to a predetermined program, based on either (i) the amount of time elapsed since the start of the program, or (ii) the total amount of user effort as determined by elapsed time as well as treadmill speed and/or treadmill slope.

Ogden et al. U.S. Pat. No. 4,635,928 has hand rails with a speed control mounted on one of the rails.

Pittaway et al. U.S. Pat. No. 4,749,181 incorporates a central processing unit which monitors various speed-related parameters and shuts down the treadmill if the parameters indicate a malfunction.

Sweeney, Sr. et al. U.S. Pat. No. 4,842,266 incorporates a microprocessor which provides pre-programmed speed variation as well as a display indicative of the performance of the user.

Kuo U.S. Pat. No. 4,865,313 relates to a mechanical arrangement for speed changing purposes.

Lin U.S. Pat. No. 4,917,375 relates to a mechanical arrangement for manually changing treadmill speed by turning a handle bar.

While these treadmills allow walking or running exercise in a confined space, they also require the person exercising to match the motion of the moving surface, at whatever speed and/or slope has been pre-programmed into the treadmill or set by the user. Since the apparatus thus "controls" the user, a risk of injury exists.

An object of the present invention is to provide an improved treadmill which is more convenient and safe to use than those of the prior art, and which varies the degree of difficulty of exercise thereon according to the actual current performance of the user.

Another object of the invention is to provide improved exercise apparatus which adapts the speed and/or slope of a moving medium traversed by the user to the exercise capability of the user.

A further object of the invention is to provide a treadmill which is capable of more accurately determining the energy expended by the user, as compared with prior art treadmills.

A still further object of the invention is to provide a treadmill which is capable of determining the cadence and gait of the user.

SUMMARY OF THE INVENTION

As herein described, there is provided exercise apparatus having a continuously movable medium adapted to be traversed by a living creature. The apparatus includes position determining means for determining the position of the body of the creature traversing the medium. Control means coupled to the position determining means reduces the speed of movement of the medium when the position of the creature moves in the direction of movement of the medium, and increases the speed of movement of the medium when the position of the creature moves in the opposite direction.

According to one aspect of the invention an adaptive treadmill is provided which has a movable tread capable of supporting a person, and motor means for moving the tread in accordance with at least one exercise parameter. Control means responsive to a control signal and coupled to the motor means varies the aforementioned exercise parameter of the tread. The treadmill also includes detecting means for determining the position of a person on the tread relative to a reference position and generating the control signal to change the aforementioned exercise parameter when the position of the person bears a predetermined relationship to the reference position.

IN THE DRAWING

Figure 1:
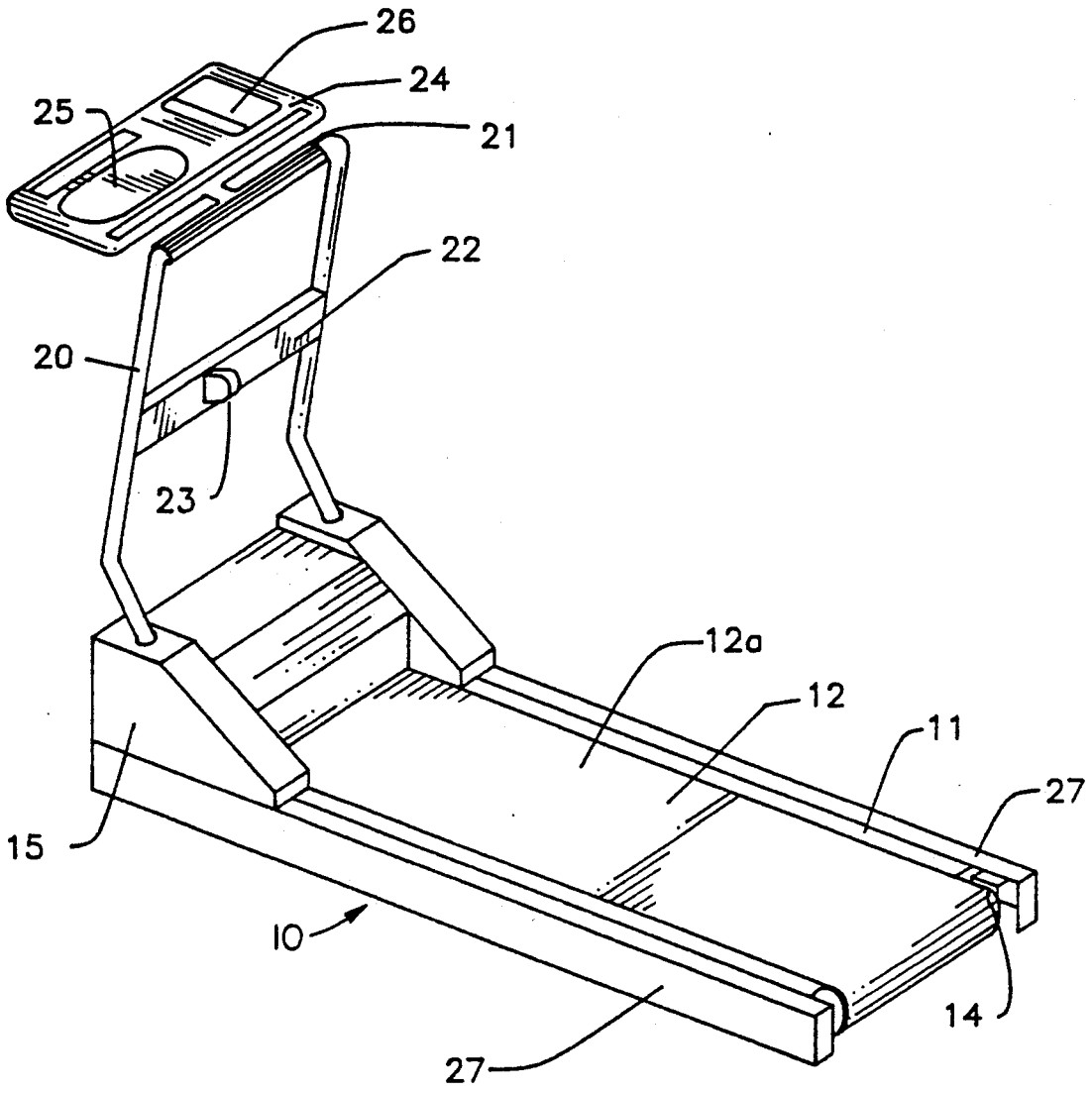
FIG. 1 is an isometric view of a treadmill according to a preferred embodiment of the present invention.
Figure 2:
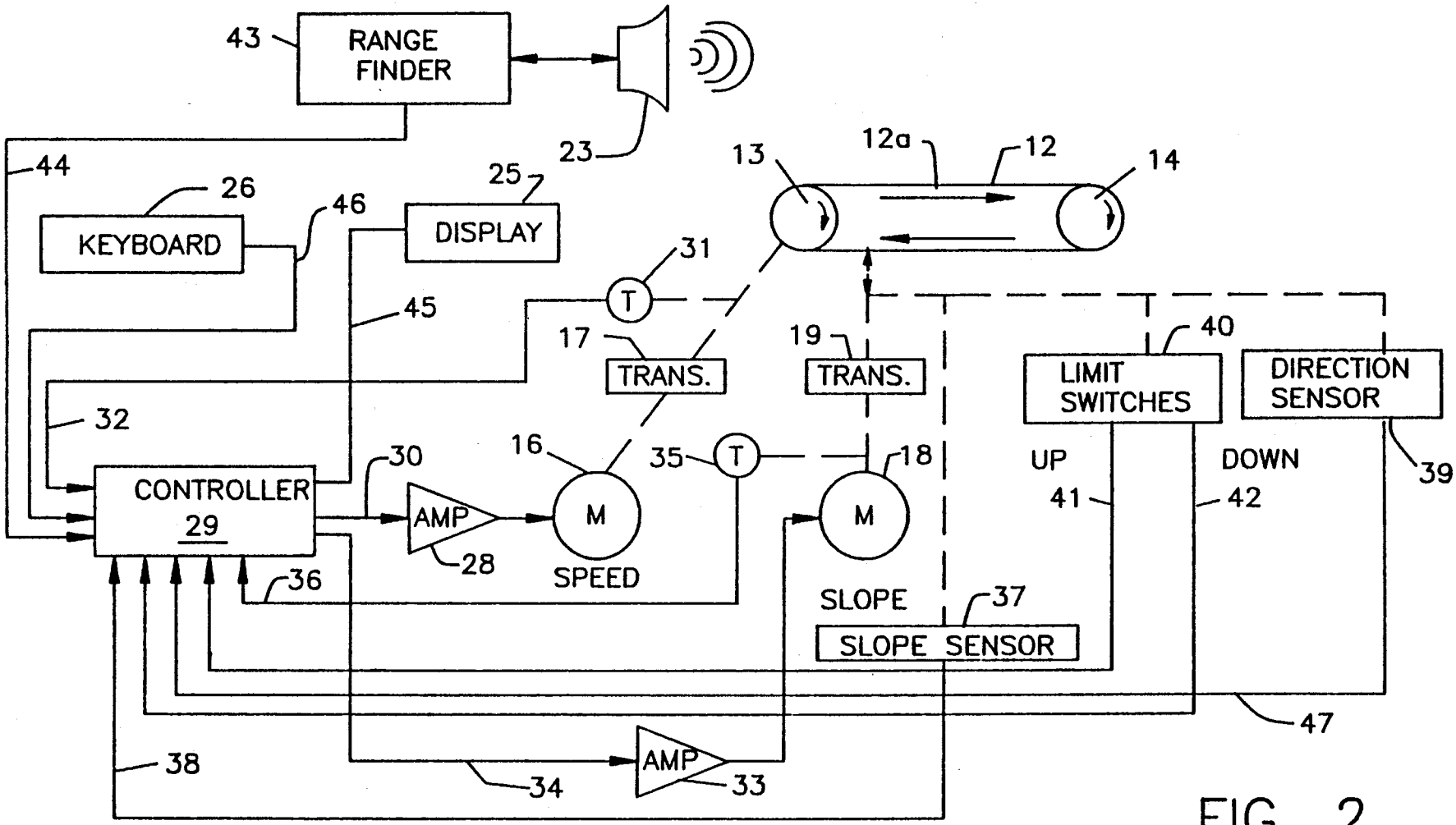
FIG. 2 is a functional block diagram of the operating portions of the treadmill shown in FIG. 1.
Figure 3A:
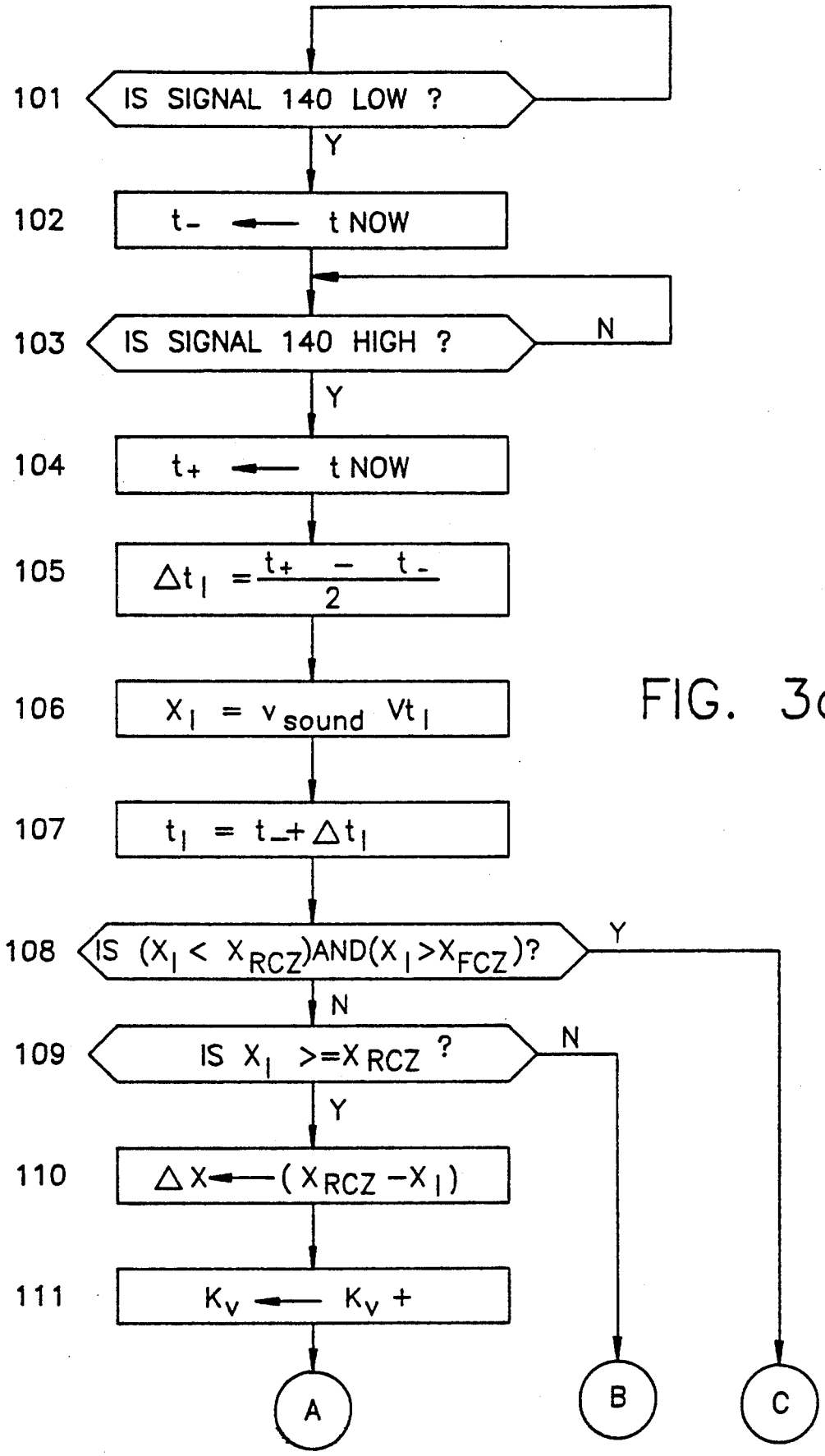
Figure 3B:
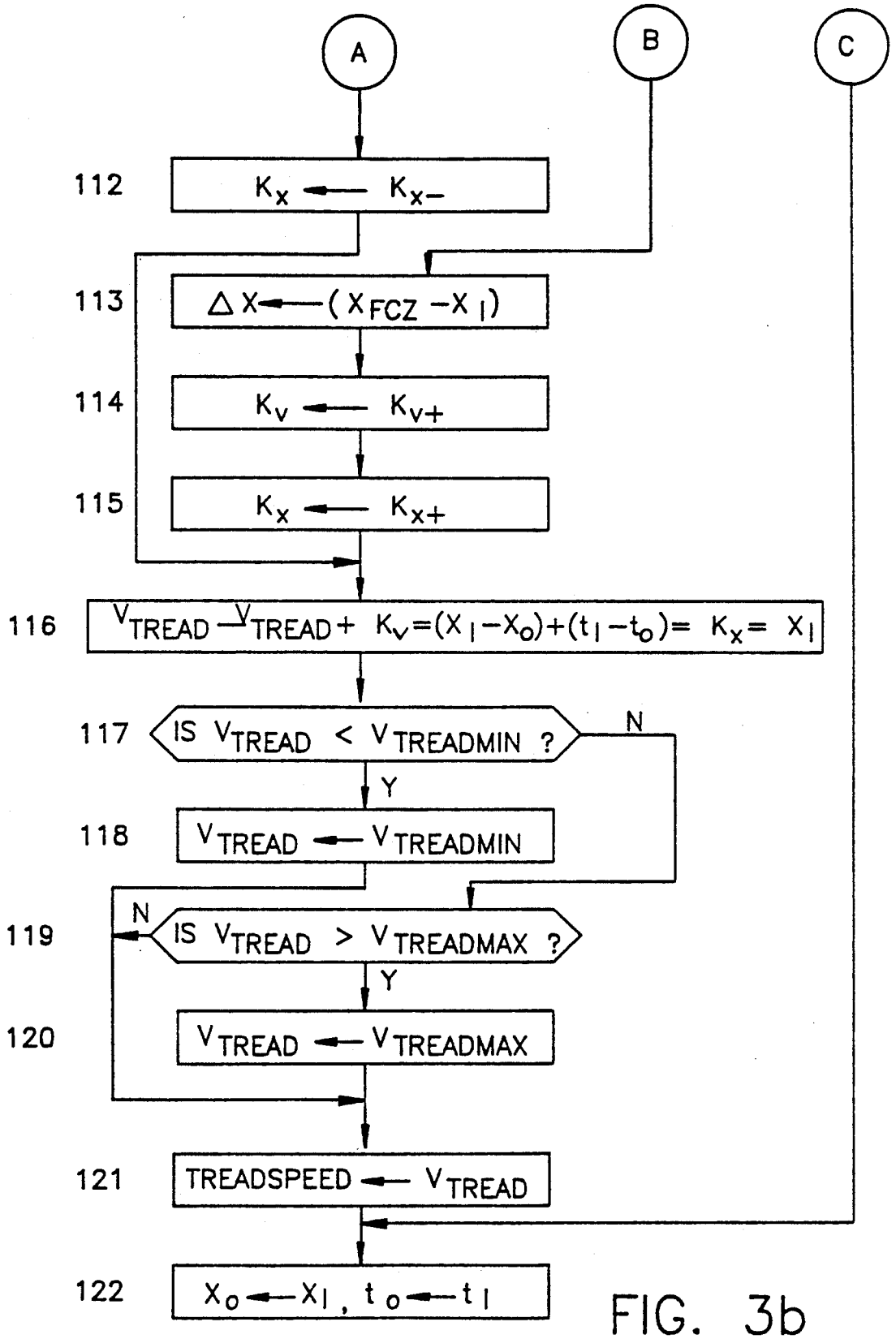
Figure 4:
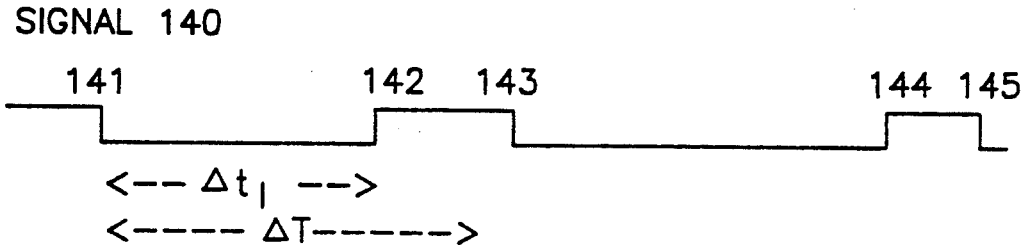
Figure 5:
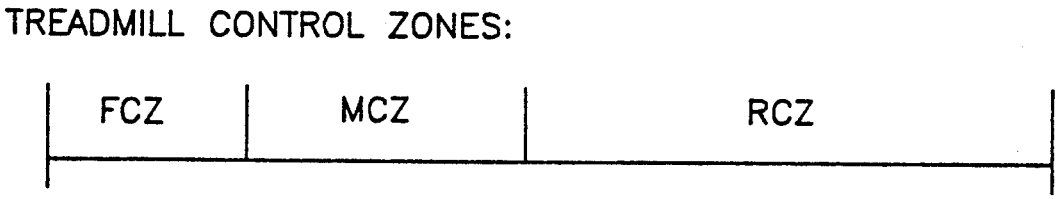
Figure 6:
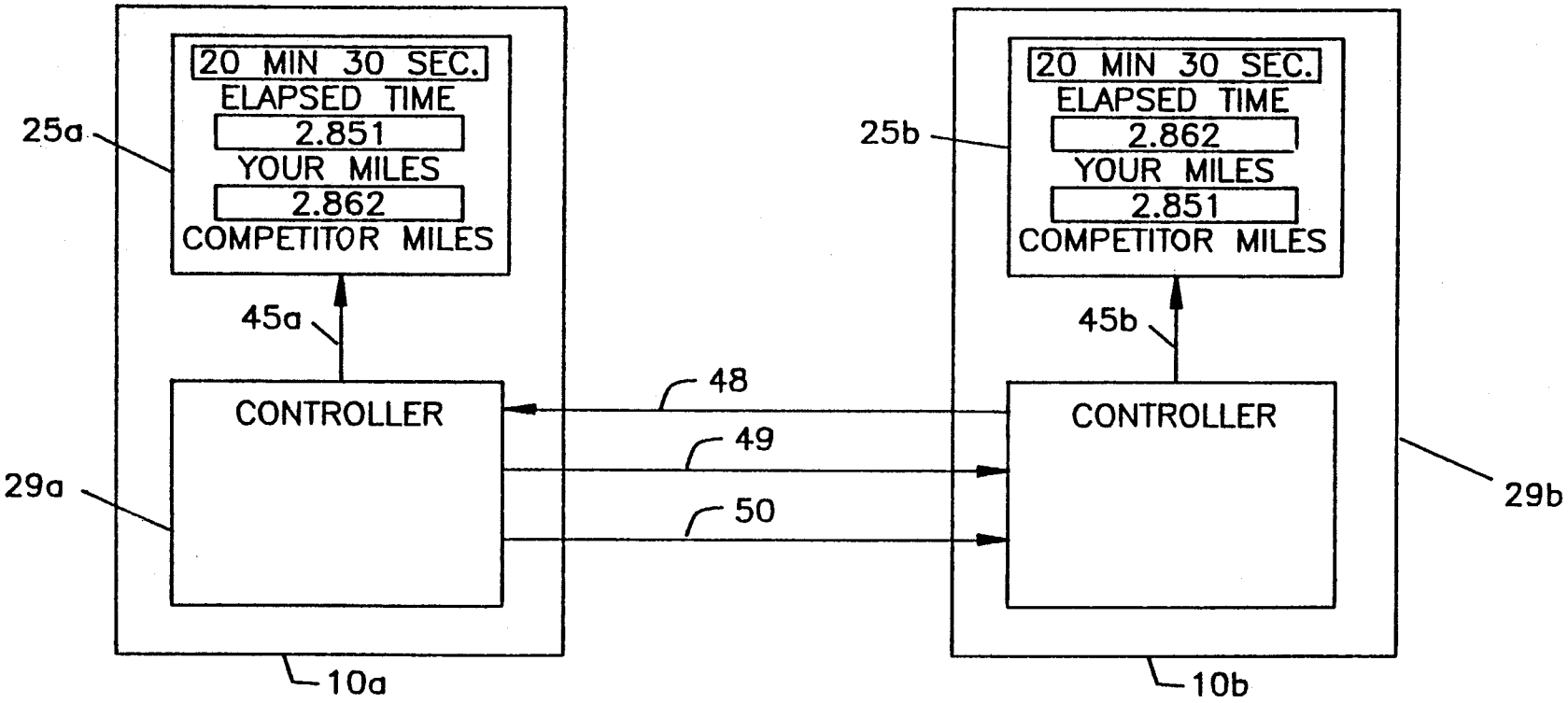

FIGS. *3a* and *3b* constitute a flow chart for the controller shown in FIG. 2;

FIG. 4 shows a waveform within the range finder utilized in the embodiment of FIGS. 1, 2 and 3;

FIG. 5 shows tread control zones as determined by the controller utilized in the embodiment of FIGS. 1, 2 and 3; and FIG. 6 is a functional block diagram showing two treadmills interconnected so that the users thereof may race with each other.

GENERAL DESCRIPTION

Typical treadmills incorporate a control panel or other control means which allows the user to select exercise parameters such as tread speed and tread slope, modify the parameters, observe a display of the tread speed, slope, and elapsed time, and review related performance measures (distance traversed, amount of work done, calories expended, etc).

As a person uses a treadmill it is necessary for the person to manually change the tread speed if the person wants to walk or run faster or slower; and to manually increase or decrease the tread slope if the person wants to work harder or less hard as well as, or in addition to, going faster or slower.

To make these speed and/or slope changes, the user must actuate the corresponding control(s) while walking or running on the tread, an action which is at best awkward, an inconvenient annoyance, and disruptive of the exercise gait; and at worst dangerous.

To overcome these deficiencies, automatic variation of the treadmill speed and/or slope is accomplished by sensing the position of the person using the treadmill (preferably by use of an ultrasonic range finder) and adjusting the treadmill speed and/or slope to maintain the distance between the person and the front of the treadmill within a range which assures that the person will not move too far forward or backward so as to end up too close to the front or rear of the tread.

The position sensor may comprise (i) a range finder which measures the time required for ultrasonic waves to traverse the distance to the person on the treadmill, (ii) a series of spaced-apart infrared light sources for transmitting corresponding parallel infrared beams to corresponding light receptors across the area above the tread in a direction perpendicular to the direction of tread movement, so that the position of the person is determined according to which of the beams are interrupted, or (iii) a resiliently mounted band or cord which rests against the torso of the user, the displacement of an end of the band or cord being an indicator of user position.

While the preferred embodiment of exercise apparatus according to the present invention is intended primarily for use by human beings, other embodiments would be suitable for use in exercising animals, for laboratory test purposes or otherwise.

The effect of this automatic user-position-sensitive control arrangement is to create an adaptive or "performance-based" treadmill. As the level of effort of the user increases, and as a result the user moves toward the front of the tread, the treadmill responds by increasing the tread speed (and/or, if programmed to do so, increasing the tread slope or inclination), thus effectively matching the increased effort. While the tread comprises an endless belt, for convenience of description reference is made to the "front" and "rear" of the tread. Such references relate to the front and rear of the exposed surface of the tread, i.e. the surface upon which the user walks or runs.

As the user's effort decreases, and the user moves toward the rear of the tread, the treadmill responds by decreasing the tread speed (and/or, if programmed to do so, decreasing the tread slope or inclination), thus effectively matching the decreased effort.

In prior art treadmills the tread speed and/or slope are either preset or altered by the user from time to time. Thus the exercise regimen is largely independent of the user's potential performance. However, in a treadmill which automatically alters the tread speed and/or slope in response to the user's position on the tread, the integrated variation of tread speed and/or slope as a function of elapsed time is a true measure of the user's potential exercise performance.

If desired, visual and audible cues indicative of the user's position with respect to the front or rear of the tread, as well as the acceleration of the tread, may be provided to the user; the velocity of the tread also being displayed, as in current treadmills. Such information may also be transmitted between a number of treadmills and/or to a central processing unit for comparison of the performance of two or more users, who may be for example engaged in a treadmill "race" with each other, or who in another embodiment may be a group of animals being tested.

The automatic user-position-sensitive arrangement for controlling the treadmill provides increased safety, not only by avoiding the need for the user to manually actuate controls while walking or running, but also by stopping the movement of the tread when it is determined that the user has fallen down or is not on the treadmill—this determination being made when the distance to the torso of the user is indeterminate or is greater than a value consistent with user being upright on the tread.

The adaptive feature of the treadmill of the present invention may be superimposed on a pre-programmed terrain profile. That is, the treadmill may be pre-programmed to vary the speed and/or slope of the tread to vary as a function of elapsed time or distance travelled, so as to simulate changes which would occur in a natural course—with the tread speed and/or slope being subject to alteration from the pre-programmed values in response to changes in the position of the user on the tread.

By analyzing the variations of the user's position on the tread, the treadmill can also derive useful information as to the user's gait and stride.

Human gait is a relatively complex phenomenon. Changes in the position of a point or region of the user's body relative to a stationary sensor while the user is moving forward can be divided into: (1) an increasing "position", (2) a repeated forward-backward motion associated with the user's rhythm or cadence, and (3) random variations associated with noise and gait variation.

The controller of the treadmill herein described extracts the "position" information to control the tread speed and/or slope, and also is capable of measuring cadence (the repeated forward-backward component of the user's position); which measure of cadence can be used to estimate related characteristics such as stride (in the case of running). The characteristic profile of the user's stride as well as non-productive variations in the stride determined by the treadmill can be used to improve the user's performance.

The treadmill thus is capable of providing information to the user which is not available in the prior art. For example, the user's position on the treadmill can be presented visually in terms of an illuminated figure in the context of the range of possible positions. An acoustic signal indicating that the user is speeding up or slowing down can be provided. A visual or acoustic presentation of stride length and/or nonproductive variations in stride can be provided to help the user improve walking or running performance. The user's performance can be summarized graphically as "trends" to facilitate comparison with earlier performance, and point out variations with time or with treadmill characteristics such as slope.

In terms of structure a preferred embodiment of the invention incorporates a sensor which provides a measure of the distance between the subject and the sensor, and a controller (signal processor) which analyzes the distance information from the sensor and provides measures of front of tread-user distance and user cadence, as well as an interface to drive tread movement and tread slope motors. Since the sensor is stationary, the distance between the sensor and the subject or user is readily converted to the desired information, namely the distance between the front of the tread and the subject or user. The distance information is processed to separate out (and, if desired, display to the user) (i) the distance from the front of the tread to the user, (ii) the normal variations therein due to the user's cadence and (iii) the random variations therein caused by noise, irregularities in cadence and non-forward-motion positional variations. The controller interface provides control signals to amplifiers which drive the tread speed and slope motors, and output information to a display and (if desired) an amplifier and speaker. The controller also accepts information from (i) transducers coupled to the tread drive and elevation motors, and (ii) a keyboard or other input device through which the user may input information and control signals.

DETAILED DESCRIPTION

As shown in FIG. 1 a treadmill 10 has a stationary tread supporting plate 11 which supports the upper portion of an endless belt 12. The belt 12 extends around a front cylindrical end roller 13 (not shown in FIG. 1)

and a rear cylindrical end roller 14 (the roller 14 is rotationally mounted on the frame 27), the portion of the belt 12 disposed on the plate 11 at any particular time serving as a tread 12*a* upon which a user of the treadmill may walk or run.

A housing 15 situated at the front of the treadmill 10 contains an electric drive motor 16 and associated transmission 17 (see FIG. 2) for rotating the front roller 13 to cause the tread 12*a* to move at a speed proportional to the speed of rotation of the motor 16.

The housing 15 also contains a second electric drive motor 18 and associated transmission 19 for varying the height of the roller 13 so as to vary the slope or inclination of the plate 11 and overlying tread.

The tread 12*a* overlying the plate 11 may typically be 4 to 6 feet in length and 1½ feet in width. The motor 16 is preferably capable of moving the tread at speeds in the range of zero to ten miles per hour.

A rail 20 having an inverted "U" shape extends from the housing 15, the upper central portion of the rail being covered with a rubber or plastic hand grip 21.

An electronic control unit ("ECU") 22 is mounted between the uprights of the rail 20, at a height of about thirty inches above the tread portion 12*a* of the belt 12.

An ultrasonic transducer horn 23 is pivotally mounted to the surface of the ECU 22 which faces the belt 12, the horn 23 being pivotable about a horizontal axis so that the horn may be oriented toward the torso of a person on the tread 12*a*.

A display/control panel 24 containing a light emitting diode display arrangement and/or a liquid crystal display panel 25 and a membrane panel keypad or keyboard 26 is mounted to the upper central portion of the rail 20.

The arrangement wherein the speed and slope of the tread 12*a* are controlled is shown in the functional block diagram of FIG. 2.

The tread speed drive motor 16 is driven by an amplifier 28 in response to a control signal from the controller 29 on line 30. The controller 29 preferably contains a microprocessor, a memory for storing a program for the microprocessor and related data, interface circuitry such as a peripheral interface adapter, analog-to-digital and digital-to-analog converters for coupling input and output signals to associated components, and a power supply; and is mounted within the ECU 22. A digital tachometer 31 coupled to the transmission 17 provides a tread speed signal to controller 29 on line 32.

The tread slope drive motor 18 is driven by an amplifier 33 in response to a control signal from the controller 29 on line 34. A tread slope sensor 37 coupled to the transmission 19 provides a tread slope signal to controller 29 on line 38 which is indicative of the angle of inclination or slope of the tread 12*a*. A digital tachometer 35 coupled to the transmission 19 provides a tread slope rate of change signal to controller 29 on line 36. A tread direction sensor 39 coupled to the transmission 19 provides a signal to controller 29 on line 47 which is indicative of whether the slope of the tread 12*a* is increasing or decreasing. Elevation limit switches 40 provide signals to the controller 29 on lines 41, 42 when the upper and lower limits of inclination of the belt 12 have been reached.

An ultrasonic range finder or radar 43 provides a range signal to the controller 29 on line 44 corresponding to the distance between (i) the region (preferably the torso) of a person on tread 12*a* in the path of ultrasonic waves from the horn 23, and (ii) the horn 23.

The range finder 43 may be similar to the Polaroid Ultrasonic Rangefinder Designer's Kit #603972 manufactured by the Polaroid Corporation of Cambridge, Mass. This device periodically or on command (from the controller 29) transmits a pulse of ultrasonic energy via the horn 23. The time needed for the pulse to travel from the transmitter, reflect from the user, or a more distant object if the user is not in the path of the ultrasonic beam, and return to the receiver provides a measure of distance. The information can enable determination of the position of the subject as well as an indication that the subject is within a prescribed position range.

As the upper or tread surface 12*a* of the belt 12 moves toward the rear of the treadmill, the pace of the person walking or running on the tread 12*a* must match the speed of the belt in order for the user to remain at a fixed position relative to the front of the treadmill, i.e. at a constant distance from the ultrasonic horn 23.

The speed of linear movement of the tread 12*a* is varied by the tread speed drive motor 16 in response to a signal from the controller 29 on line 30. The actual speed of the belt 12 is sensed by the tachometer 31 and this information is displayed to the user via the controller 29 and display 25 via line 45. The controller 29 contains a storage device (such as a non-volatile memory) which stores information as to the variation of treadmill speed and/or slope with time, for later analysis or other use.

If desired, instead of the tachometer 31, the speed of the tread 12*a* may be directly measured by an ultrasonic Doppler effect speed monitor having a transducer horn mounted on the ECU 22 and oriented downward so as to reflect ultrasonic energy from the tread 12*a*, the difference in frequency between the incident and reflected ultrasonic waves being a measure of the tread speed. Alternatively, the horn 23 may be motor-driven about its horizontal pivot axis so as to alternately sense the (position of the) person on the tread and the (speed of the) tread.

The controller 29 monitors the speed of the belt 12 as indicated by the tachometer 31, and adjusts the control signal it sends to the amplifier 28 on line 30, so that the speed of the tread and the rate of change of the tread speed, are maintained within predetermined limits. The tread speed is preferably maintained by the controller 29 in the range of one to ten miles per hour, a range which is quite adequate to accommodate the range of speeds at which a person using the treadmill may be expected to walk or run. The rate of change of tread speed (acceleration or deceleration) is preferably limited to an acceleration of one mile per hour per second, and a deceleration of three miles per hour per second; as these values allow the tread to reach the desired speed, or to stop, sufficiently fast so as not to annoy the user with undue delay, while being sufficiently gradual so as to minimize any jerk which might cause the user to lose balance or fall down.

The controller 29 cooperates with the amplifier 28, motor 16, transmission 17, roller 13, belt 12, range finder 43 and horn 23, to form a negative feedback loop in which the position of the user on the tread 12*a* is compared by the controller 29 with a reference position corresponding to the center (lengthwise) of the tread; and the motor 16 is driven so as to vary the speed of the tread to maintain the user in this central position.

Whenever the range finder 43 generates a signal indicating that the distance to the nearest object in the path of ultrasonic signals from the horn 23 is greater than the distance from the horn 23 to the rear of the tread 12*a* (i.e. approximately the distance to the rear roller 14), the controller 29 brings the belt 12 to a stop by decelerating the tread 12*a* at the aforementioned rate of three miles per hour per second, so that a maximum of 3⅓ seconds is required to stop the tread. Thus the controller 29 will automatically stop the tread if there is no one on the tread, or if the user falls down on the tread so that no part of the user's body is in the path of ultrasonic waves from the horn 23.

When the user first gets on the tread 12*a* the range finder 43 and controller 29 determine that the distance to the nearest object in the path of ultrasonic waves from the horn 23 corresponds to the object being on the tread 12*a*, and the controller, after a small preset time delay, causes the tread to begin moving and to accelerate at the aforementioned rate of one mile per hour per second.

If the user increases walking/running speed so as to maintain a distance from the horn 23 which is constant or in a predetermined small range, as determined by the programming of the controller 29, the controller 29 causes the belt 12 to continue to accelerate until the maximum speed of ten miles per hour is reached. However, if the user does not walk or run sufficiently fast to keep up with the tread as it accelerates, the user will be moved toward the rear of the tread 12*a* and this change in position will be detected by the range finder 43 and communicated to the controller 29, which will reduce the tread speed and, if the controller is so programmed, reduce the tread slope by sending a corresponding control signal to the slope drive motor amplifier 33 on line 34. It may be desirable to reduce the slope below zero to provide a slight negative or downhill slope, in situations where therapeutic exercise is to be provided for rehabilitation of neurologically or physically impaired patients until the user is determined to be at a central position (or in a central range) on the tread 12*a*.

Similarly, if the user walks or runs at a speed greater than that of the tread 12*a*, the user will advance toward the front of the tread. This change in position will be detected by the range finder 43 and communicated to the controller 29, which will increase the tread speed and, if the controller is so programmed, increase the tread slope by sending a corresponding control signal to the slope drive motor amplifier 33 on line 34, until the user is determined to be at a central position (or in a central range) on the tread 12*a*.

The user may turn the treadmill on and off, and may elect more gradual acceleration and/or deceleration than the aforementioned default values, by entering corresponding commands to the controller 29 via the keyboard 26 and line 46. Prior to beginning the exercise, the user may use the keyboard to store a desired exercise protocol (tread speed and/or slope as a function of elapsed time or distance traveled) in the controller 29. The user may also use the keyboard 26 to specify the type and manner of presentation of information to be shown on the display 25. Such information may include a measure of user performance such as average speed, as well as a target performance level such as target average speed; and a display of the extent to which the user is achieving the desired performance level, such as percentage of target average speed.

The elevation of the tread 12*a* may be manually changed by the user from a horizontal level to a desired degree of slope or inclination, by commanding the controller 29 via the keyboard 26, to either gradually increase the slope at a specified rate, or changing the slope to a specified value, by raising the front roller 13 so that the user has the experience of moving up an incline or hill. In response the controller 29 supplies a signal to the amplifier 33 which causes the motor 18 and transmission 19 to produce the desired movement of the roller 13 and tread 12*a*, monitoring the slope of the tread, its rate of change, the direction of change, and its upper and lower limits by means of the elements 37, 35, 39, and 40 respectively.

The controller 29 determines and may indicate on the display 25, information such as (i) user position, (ii) tread speed, (iii) tread acceleration, (iv) tread slope or inclination, (v) elapsed time, (vi) distance traveled, (vii) amount of work done by the user determined as a function of elapsed time, distance traveled and tread slope, (viii) calories consumed corresponding to the amount of work done, (ix) stride length, (x) a measure of the irregularity in stride, and (xi) exercise protocols, either in numerical or graphical format.

As shown in FIG. 5, the controller 29 defines three areas on the tread: a Front Control Zone corresponding to the front one-quarter of the tread; a Middle Control Zone corresponding to the middle one-quarter of the tread; and a Rear Control Zone corresponding to the rear one-half of the tread. The relatively large size of the Rear Control Zone is chosen to provide additional response time to help the control system of the treadmill to keep the user away from the rear end of the tread.

If the controller 29 determines that the user's position on the tread corresponds to a position within the Front Control Zone, then the controller 29 increases the speed of the tread 12*a* at a rate proportional to both the distance the user has intruded into the Front Control Zone and the rate at which the user is moving forward in the Front Control Zone. The acceleration of the tread is shown in Equation (1): where $$\frac{dv_{tread}(t)}{dt} = k_{v+}\frac{dx(t)}{dt} + k_{x+}x(t) \quad (1)$$

| | |
|---|---|
| $x(t)$ | is the time varying (positive) distance of the user into the Front Control Zone; |
| $k_{v+}$ and $k_{x+}$ | are predetermined constants of proportionality; and |
| $v_{tread}(t)$ | is the time varying tread speed setting. |

The constant of proportionality $k_{x+}$ is chosen so as to present the greatest rate of increase in tread speed possible when the user maintains a position at the extreme forward limit of the tread. The constant of proportionality $k_{v+}$ is chosen so as to retard any increase in tread speed while the user is moving backward in the Front Control Zone (i.e. toward the Rear Control Zone) to the extent that the tread speed 12*a* isn't appreciably increased or decreased beyond the tread speed at the time when the user began to move backward in the Front Control Zone.

This method of controlling the tread speed is known in the art as proportional-integral (PI) feedback control. The controller 29 realizes a discrete-time implementation of this feedback control by means of the relationship in Equation (2).

$$\frac{v_{tread}(t_1) - v_{tread}(t_0)}{t_1 - t_0} = k_{v+} \frac{x(t_1) - x(t_0)}{t_1 - t_0} + k_{x+}x(t_1) \quad (2)$$

where $t_0$ is the time at which the distance was measured;

$t_1$ is the time at which the distance was subsequently measured.

Equation (2) can be rewritten as Equation (3) which is a form more convenient for programming:

$$V_{tread}(t_1) = V_{tread}(t_0) + k_{v+}(x(t_1) - x(t_0)) - (t_1 - t_0)k_{x+}x(t_1) \quad (3)$$

After each successive interrogation of the range finder 43, the controller 29 determines a new value of $v_{tread}$ and sets the tread speed as near this value as practicable. The preferred value of the constant of proportionality $k_v$, shown in Equation (4), $$k_v = 2\sqrt{k_s} \quad (4)$$

causes the controller 29 to adjust the tread speed such that once the user maintains a desired speed with respect to the tread 12*a* within the Front Control Zone, the user is moved to the edge of the Front Control Zone but no further—and the tread speed is ultimately adjusted to exactly the speed of the user with respect to the tread 12*a*.

If the controller 29 determines that the user's position on the tread corresponds to a position within the Rear Control Zone, then the controller 29 decreases the speed of the tread 12*a* at a rate proportional to both the distance the user has intruded into the Rear Control Zone and the rate at which the user is proceeding backward into the Rear Control Zone. The deceleration of the tread is shown in Equation 5:

$$\frac{dv_{tread}(t)}{dt} = k_{v-} \frac{dx(t)}{dt} + k_{x-}x(t) \quad (5)$$

The constant of proportionality $k_{x-}$ is chosen so as to present the greatest rate of decrease in tread speed permissible when the user maintains a position at the extreme rear limit of the tread. The constant of proportionality $k_{v-}$ is chosen so as to retard any decrease in tread speed while the user is moving forward in the Rear Control Zone (i.e. toward the Middle Control Zone) to the extent that the tread speed 12*a* isn't appreciably increased or decreased beyond the tread speed at the time when the user began to move toward the Middle Control Zone. This is exactly the control method applied to the case when the user is in the Front Control Zone; except that the distance x is now taken as the (negative) distance from the edge of the Rear Control Zone to the user, and the constants of proportionality $k_{x-}$, $k_{v-}$ may be adjusted to reflect a maximum rate of deceleration of magnitude unequal to the magnitude of the maximum rate of acceleration within the Forward Control Zone.

A high level flow chart showing the operation of the program which controls the microprocessor within the controller 29 is shown in FIGS. 3*a* and 3*b*.

FIG. 4 shows a waveform signal 140 within the range finder 43. This waveform goes low when a ranging pulse is transmitted and goes high when an echo is received; so that the duration of the low segments of the waveform corresponds to the distance between the range finder and the nearest object in the path of the ultrasonic range finding beam.

The range finder 43 initiates a distance measurement which is indicated by a high to low transition of signal 140 at point 141. Signal 140 remains low until the range finder detects an echo, at which time signal 140 makes a low to high transition at point 142. Signal 140 remains high until the initiation of a subsequent range measurement at point 143.

The range finder is driven by a free-running multivibrator or other oscillator which initiates successive range measurements every 65 milliseconds as shown by $\Delta T$ in Equation (6).

$$\Delta T = 65\ ms \quad (6)$$

If an echo is not detected within the 65 ms. period, the range finder will return signal 140 to a high level 144 before the beginning of the subsequent measurement, so that the initiation of the subsequent measurement can be detected by a high to low transition as shown, e.g., at point 145.

The propagation time of the ultrasonic wave from the horn 23 (FIGS. 1 and 2) to an object in the path of the ultrasonic wave is proportional to the interval in which the digital signal 140 is set to a low level as shown in Equation (7):

$$\Delta t_1 = \frac{t_+ - t_-}{2} \quad (7)$$

where $t_-$ is the time (point 141) at which the range finder 43 initiates a range measurement;

$t_+$ is the time (point 142) at which the range finder 43 detects a first echo;

$\Delta t_1$ is the propagation time of the ultrasonic wave (emitted at time $t_-$) from the horn 23, to the object in the path of the wave.

The distance from the horn to the object at time $t_1$ is proportional to the propagation time $\Delta t_1$ as shown in Equations (8 and 9). Any variations in the speed of propagation of the ultrasonic wave due to variations in the atmosphere between the horn and the rear end of the treadmill are presumed to be negligible.

$$x_1 = v_{sound} \cdot \Delta t_1 \quad (8)$$

$$t_1 = t_- + \Delta t_1 \quad (9)$$

where $t_1$ is the time at which the ultrasonic wave impinged upon the object;

$v_{sound}$ is the speed of propagation of the ultrasonic wave through air;

$x_1$ is the distance from said horn to said object at time $t_1$.

The flow chart of FIGS. 3*a* and 3*b* shows the signal processing performed by the controller 29 to estimate the speed and position of the user on the tread 12*a* and to adjust the speed of the tread according to these estimates.

At Step 102 the processor 29 records the time $t_-$ at which the range finder initiates the range measurement. At Step 104 the processor then records the time $t_+$ at which the range finder indicates the echo return. At Step 105 the processor computes the time of flight $\Delta t_1$ from the horn 23 to the object using Equation (7).

From the time of flight, at Step 106 the processor then calculates the distance $x_1$ corresponding to the distance from the horn 23 to the user according to Equation (8) and the time $t_1$ (Step 107) at which the ultrasonic wave emitted from the horn impinged upon the user according to Equation (9).

At Step 108 the processor then determines if the user is in the Middle Control Zone. If so, the tread speed $v_{TREAD}$ is not updated and the processor goes to Step 122.

At Step 109, if the processor determines the user is in the Rear Control Zone, then at Step 110 the processor calculates the (negative) amount $\Delta x$ by which the user is in the Rear Control Zone; and selects the predetermined deceleration parameters $k_{v-}$ and $k_{x-}$ as the active acceleration parameters $k_v$ (at Step 111) and $k_x$, (at Step 112) respectively.

If the user is in the Front Control Zone, at Step 113 the processor calculates the (positive) amount $\Delta x$ by which the user is in the Front Control Zone and selects the predetermined acceleration parameters $k_{v+}$ and $k_{x+}$ as the active acceleration parameters $k_v$ (Step 114) and $k_x$, Step (115) respectively.

At Step 116 The processor then calculates a new tread speed $v_{TREAD}$ according to Equation (3).

As a safety check, at Step 117 the processor determines whether the calculated tread speed $v_{TREAD}$ is less than a predetermined minimum tread speed $V_{TREAD-MIN}$. If so, at Step 118 the processor sets the calculated tread speed to the minimum tread speed. At Step 119 the processor determines whether the calculated tread speed $v_{TREAD}$ is greater than a predetermined maximum tread speed $V_{TREADMAX}$. If so, at Step 120 the processor sets the calculated tread speed to the maximum tread speed.

At Step 121 the processor then adjusts the control signal of control line 30 to correspond to the calculated tread speed $v_{TREAD}$. This step does not address acceleration rates of the treadmill. However, the motor and transmission mechanical parameters limit the acceleration and deceleration rates. If desired, the controller 29 can determine the acceleration and deceleration by numerically determining the rate of change of the tread speed and slope, and vary the drive signals to the corresponding motors to limit the acceleration and deceleration to predetermined safe values.

At Step 122 the processor replaces the results of the previous range measurements with those results just calculated.

FIG. 6 is a functional block diagram showing an arrangement wherein two treadmills 10*a* and 10*b* may "race" with each other. Each of the treadmills 10*a* and 10*b* is identical to the treadmill 10 shown in FIGS. 1 to 3, except that their respective controllers 29*a* and 29*b* include features and their respective displays 25*a* and 25*b* include information enabling a comparison of the performance of the user of one treadmill with that of the user of the other treadmill.

The controller 29*a* of treadmill 10*a* has stored therein treadmill slope variation information which specifies a predetermined slope-distance profile corresponding to the slope variations in the "terrain" over which the users of the treadmills are to "race". This slope variation information is used internally by the treadmill 10*a* to vary the slope of the treadmill as a function of the distance traveled by the user of treadmill 10*a*.

The slope variation information stored within controller 29*a* of treadmill 10*a* is also provided to the controller 29*b* of treadmill 10*b* on line 50, and is used by the treadmill 10*b* to vary the slope of the treadmill as a function of the distance traveled by the user of treadmill 10*b*. Alternatively, the same slope variation information could be stored in the controllers of both treadmills, with the stored information used to control the corresponding treadmill.

After the users of both treadmills have started (preferably at the same time unless one user is to have a "handicap" for the race) to walk or run on the treads thereof, the controller 29*a* provides data to the display 25*a* of treadmill 10*a* as to the elapsed time and the distance traveled by the user of treadmill 10*a*.

The distance traveled data is also coupled to controller 29*b* of treadmill 10*b* via line 49 so that this data can be shown on its display 25*b*. Similarly, data as to the distance traveled by the user of treadmill 10*b* is coupled to controller 29*a* via line 48 so that this data can be shown on its display 25*a*.

Thus the displays of both treadmills show the same elapsed time, and each display shows the distance traveled (over terrain having the same slope-distance profile for both treadmills) by both the user of that treadmill and the competitor—so that the user of each treadmill can compare his performance with that of his competitor on a real time basis, with the winner of the race being the first user to travel a given distance. The displays in FIG. 4 could, for example, relate to a three mile race.

The treadmill 10*a* can allow the user to "race" against himself, i.e. against his own prior performance. In such an arrangement, slope variation (with distance traveled) information stored within the controller 29*a* varies the slope of the treadmill as a function of the distance traveled by the user of treadmill 10*a*—just as in the case of the above-described two-person race. The resulting variations of distance traveled as a function of elapsed time are stored in a non-volatile memory (such as a magnetic disk or a continually powered semiconductor memory) coupled to the controller 29*a*.

On a subsequent occasion the user of treadmill 10*a* can choose to "compete" against his own prior performance by having the controller 29*a* display his prior performance via the "Competitor Miles" readout of display 25*a* based on the information previously stored in the non-volatile memory. Thus as he walks or runs on the treadmill, the user can see how many miles he previously traveled over "terrain" with the same slope-distance profile in the same elapsed time on the prior occasion, giving him an incentive to better his prior performance.

While the invention has been described with reference to a treadmill, it is also applicable to other exercise apparatus wherein a person or other living creature traverses a moving medium. For example, in a swim tank in which water flows to create a current, and a person swims against the current so as to stay in the center of the tank, the control arrangement of the present invention could be used to monitor the position of the swimmer and vary the speed of the current in response to changes in that position, so that the swimmer stays in the center of the swim tank.

We claim:

1. An adaptive treadmill comprising:

a movable tread capable of supporting a person;

motor means for moving the tread at a speed which may be varied;

control means responsive to a control signal and coupled to said motor means for varying the speed of the tread;

detecting means for determining the position of a person on said tread relative to a reference position and generating said control signal to change the speed of the tread when the position of said person bears a predetermined relationship to said reference position; and means for determining the rate of change of said person's position relative to said reference position and modifying said control signal in response thereto.

2. The treadmill according to claim 1, wherein said treadmill has a forward end, said tread moves in a direction away from said forward end, and said control signal (i) causes the speed of the tread to increase when said person advances toward said forward end to a predetermined extent, and (ii) causes the speed of the tread to decrease when said person retreats away from said forward end to a predetermined extent.

3. The treadmill according to claim 1, wherein said detecting means comprises radar means.

4. The treadmill according to claim 1, wherein said detecting means comprises ultrasonic distance determining means.

5. The treadmill according to claim 1, wherein said detecting means comprises ultrasonic means for determining the time required for an ultrasonic signal to travel from a reference position of to a position a given height above the tread and to return to the reference position after being reflected by a person on the tread, and for comparing said time to a reference time.

6. The treadmill according to claim 5, wherein said given height is in the range of thirty to sixty inches.

7. A motor-driven treadmill having a continuously movable tread and including a stationary range finder for continuously measuring the distance from the range finder to part of the body of a person walking or running on the tread, means for determining the rate of change of said distance, and means coupled to the range finder and responsive to the rate of change of said distance from reducing the speed of movement of the tread when said distance increases above an upper distance limit and increasing the sped of movement of the tread when said distance decreases below a lower distance limit.

8. The treadmill according to claim 7, wherein at least one of said distance limits is set in dependence upon the rate at which the distance between the body of said person and said range finder is changing.

9. A motor-driven treadmill having a continuously movable tread and including a position determining means for continually determining the position of the body of a person on the tread, means for determining the rate of change of said distance, and means coupled to the position determining means and responsive to the rate of change of said position for reducing the speed of movement of the tread when said position changes in the direction of movement of the tread, and increasing the speed of movement of the tread when said position changes in the opposite direction.

10. In combination, first and second motor-driven treadmills, each of said treadmills having a continuously movable tread and including a position determining means for continually determining the position of the body of a person on the tread, means for determining the rate of change of said distance, and means coupled to the position determining means and responsive to the rate of change of said position for reducing the speed of movement of the tread when said position changes in the direction of movement of the tread when said position changes in the direction of movement of the tread, and increasing the speed of movement of the tread when said position changes in the opposite direction;

each of said treadmills including (i) race parameter transmitting means for transmitting to the other treadmill race parameter data as to a race parameter indicative of the performance of a person using the treadmill, and (ii) race parameter display means for displaying to the user of the treadmill the race parameter data for said user as well as the race parameter data for the user of the other treadmill, so that each user can compare the performance of the users of the two treadmills on a real time basis.

11. The combination according to claim 10, further including slope varying means for varying the slope of each treadmill as a function of distance travelled by the user of that treadmill, in accordance with a predetermined terrain profile.

12. The combination according to claim 10 or 11, wherein said race parameter is distance travelled.

13. A motor-driven treadmill comprising:

a continuously movable tread;

position determining means for continually determining the position of the body of a person on the tread;

means coupled to the position determining means, means for determining the rate of change of said distance, and responsive to the rate of change of said position for reducing the speed of movement of the tread when said position changes in the direction of movement of the tread, and increasing the speed of movement of the tread when said position changes in the opposite direction;

target performance setting means for generating target performance data indicative of the desired performance of a person using the treadmill; and relative performance display means for displaying to the user of the treadmill, on a real time basis, relative performance parameter data indicative of the extent to which the user is falling short of or exceeding a performance level corresponding to the target performance data.

14. The treadmill according to claim 13, wherein the tread of said treadmill has a slope which can be varied in response to a slope control signal, and said target performance setting means generates said slope control signal to vary the slope of the treadmill as a function of distance travelled by the user, in accordance with a predetermined terrain profile.

15. The treadmill according to claim 13 or 14, wherein said target performance data comprises data as to distance travelled by the user.

16. The treadmill according to claim 13 or 14, wherein said target performance data comprises data indicative of energy expended by the user.

17. Exercise apparatus having a continuously movable medium adapted to be traversed by a living creature, including a stationary range finder for continually measuring the distance from the range finder to part of the body of a living creature traversing the medium, and control means coupled to the range finder and responsive to the rate of change of said distance for reducing the speed of movement of the medium when said distance increases above an upper distance limit and increasing the speed of movement of the medium when said distance decreases below a lower distance limit.

18. Exercise apparatus having a continuously movable medium adapted to be traversed by a living creature, including position determining means for determining the position of the body of a living creature traversing the medium, means for determining the rate of change of said distance, and control means coupled to the position determining means and responsive to the rate of change of said position for reducing the speed of movement of the medium when the position of the creature moves in the direction of movement of the medium, and increasing the speed of movement of the medium when said position moves in a direction opposite to said direction of movement of the medium.

19. An adaptive treadmill comprising:

a movable tread capable of supporting a person;

motor means for moving the tread in accordance with at least one exercise parameter;

control means responsive to a control signal and coupled to said motor means for varying said at least one exercise parameter of the tread; and detecting means for determining the position of a person on said tread relative to a reference position and generating said control signal to change said at least one exercise parameter when the position of said person bears a predetermined relationship to said reference position, said control means stopping the movement of the tread when said detecting means determines that no one is on the tread.

20. An adaptive treadmill comprising:

a movable tread capable of supporting a person;

motor means for moving the tread at a speed which may be varied;

control means responsive to a control signal and coupled to said motor means for varying the speed of the tread; and detecting means for determining the position of a person on said tread relative to a reference position and generating said control signal to change the speed of the tread when the position of said person bears a predetermined relationship to said reference position, said control means stopping the movement of the tread when said detecting means determines that no one is on the tread.

21. An adaptive treadmill comprising:

a movable tread capable of supporting a person;

motor means for moving the tread in accordance with at least one exercise parameter;

control means responsive to a control signal and coupled to said motor means for varying said at least one exercise parameter of the tread; and detecting means for determining the position of a person on said tread relative to a reference position and generating said control signal to change said at least one exercise parameter when the position of said person bears a predetermined relationship to said reference position;

wherein said control means includes stop signal generating means for providing a stop signal when no object is within a predetermined range of positions on the treadmill; and shutdown means responsive to said stop signal for halting the movement of the tread.

22. An adaptive treadmill comprising:

a movable tread capable of supporting a person;

motor means for moving the tread at a speed which may be varied;

control means responsive to a control signal and coupled to said motor means for varying the speed of the tread; and detecting means for determining the position of a person on said tread relative to a reference position and generating said control signal to change the speed of the tread when the position of said person bears a predetermined relationship to said reference position;

wherein said control means include stop signal generating means for providing a stop signal when no object is within a predetermined range of positions on the treadmill; and shutdown means responsive to said stop signal for halting the movement of the tread.

23. A motor-driven treadmill having a continuously movable tread and including:

a stationary range finder for continuously measuring the distance from the range finder to part of the body of a person walking or running on the tread; and control means coupled to the range finder for reducing the speed of movement of the tread when said distance increases above an upper distance limit and increasing the speed of movement of the tread when said distance decreases below a lower distance limit;

wherein said control means includes stop signal generating means for providing a stop signal when no object is within a predetermined range of positions on the treadmill; and shutdown means responsive to said stop signal for halting the movement of the tread.

24. The treadmill according to claim 23, wherein at least one of said distance limits is set in dependence upon the rate at which the distance between the body of said person and said range finder is changing.

25. A motor-driven treadmill having a continuously movable tread and including:

a position determining means for continually determining the position of the body of a person on the tread; and control means coupled to the position determining means for reducing the speed of movement of the tread when said position changes in the direction of movement of the tread, and increasing the speed of movement of the tread when said position changes in the opposite direction;

wherein said control means includes stop signal generating means for providing a stop signal when no object is within a predetermined range of positions on the treadmill; and shutdown means responsive to said stop signal for halting the movement of the tread.

26. An adaptive treadmill comprising:

a movable tread capable of supporting a person;

motor means for moving the tread at a speed which may be varied;

motor control means responsive to a control signal and coupled to said motor means for varying the speed of the tread in accordance with said control signal;

detecting means for determining the position of a person on said tread relative to a reference position; and signal processing means coupled to said detecting means for generating said control signal, said signal processing means comprising rate determining means for determining the rate of change of said position, zone determining means for determining when the position of said person is in a front control zone corresponding to a predetermined forward portion of said tread, and when said position is in a rear control zone corresponding to a predetermined rear portion of said tread, and speed control means for modifying said control signal when said person is in said front control zone, to cause said motor control means to increase the speed of the tread at a rate proportional to both the distance said person has intruded into the front control zone and the rate of change at which said person is moving forward in the front control zone.

27. The treadmill according to claim 26, wherein when said person is at the forward end of said front control zone, said speed control means modifies said control signal to cause said motor control means to provide maximum acceleration of said tread.

28. The treadmill according to claim 26 or 27, wherein when said person is in said rear control zone, said speed control means modifies said control signal to cause said motor control means to decrease the speed of the tread at a rate proportional to both the distance said person has intruded into the rear control zone and the rate at which said person is moving backward in said rear control zone.

29. An adaptive treadmill comprising:

a movable tread capable of supporting a person;

motor means for moving the tread at a speed which may be varied;

motor control means responsive to a control signal and coupled to said motor means for varying the speed of the tread in accordance with said control signal;

detecting means for determining the position of a person on said tread relative to a reference position; and signal processing means coupled to said detecting means for generating said control signal, said signal processing means comprising rate determining means for determining the rate of change of said position, zone determining means for determining when the position of said person is in a front control zone corresponding to a predetermined forward portion of said tread, and when said position is in a rear control zone corresponding to a predetermined rear portion of said tread, and speed control means for modifying said control signal (i) when said person is in said front control zone, to cause said motor control means to increase the speed of the tread at a rate dependent upon both the distance said person has intruded into the front control zone and the rate at which said person is moving forward relative to said reference position in the front control zone, and (ii) when said person is in said rear control zone, to cause said motor control means to decrease the speed of the tread at a rate dependent upon both the distance said person has intruded into the rear control zone and the rate at which said person is moving backward relative to said reference position in said rear control zone.

* * * * *